US011664000B1

(12) United States Patent
Zou et al.

(10) Patent No.: US 11,664,000 B1
(45) Date of Patent: May 30, 2023

(54) SYSTEMS AND METHODS FOR MODIFYING BIQUAD FILTERS OF A FEEDBACK FILTER IN FEEDBACK ACTIVE NOISE CANCELLATION

(71) Applicant: Cirrus Logic International Semiconductor Ltd., Edinburgh (GB)

(72) Inventors: Ziyan Zou, Austin, TX (US); K. Joshua Bodon, Austin, TX (US); Sandeep P. Sira, Gilbert, AZ (US)

(73) Assignee: Cirrus Logic, Inc., Austin, TX (US)

( * ) Notice: Subject to any disclaimer, the term of this patent is extended or adjusted under 35 U.S.C. 154(b) by 51 days.

(21) Appl. No.: 17/496,253

(22) Filed: Oct. 7, 2021

(51) Int. Cl.
*G10K 11/178* (2006.01)

(52) U.S. Cl.
CPC .. *G10K 11/17823* (2018.01); *G10K 11/17815* (2018.01); *G10K 11/17854* (2018.01); *G10K 11/17875* (2018.01); *G10K 11/17885* (2018.01)

(58) Field of Classification Search
CPC ..... G10K 11/17823; G10K 11/17875; G10K 11/17885; G10K 11/17815; G10K 11/17854
USPC ..... 381/71.11
See application file for complete search history.

(56) References Cited

U.S. PATENT DOCUMENTS

2010/0266134 A1* 10/2010 Wertz ..... G10K 11/17879 381/71.1
2010/0272283 A1* 10/2010 Carreras ..... G10K 11/17823 381/71.6
2011/0243343 A1* 10/2011 Gauger, Jr. ..... G10K 11/16 381/71.6
2012/0140943 A1* 6/2012 Hendrix ..... G10K 11/17823 381/71.11
2018/0136899 A1* 5/2018 Risberg ..... H04R 3/04

* cited by examiner

*Primary Examiner* — Paul Kim
*Assistant Examiner* — Douglas J Suthers
(74) *Attorney, Agent, or Firm* — Jackson Walker L.L.P.

(57) ABSTRACT

An integrated circuit may include an output for providing an output signal to a transducer including both a source audio signal for playback to a listener and an anti-noise signal for countering the effect of ambient audio sounds in an acoustic output of the transducer, an error microphone input for receiving an error microphone signal indicative of the output of the transducer and the ambient audio sounds at the transducer, and a processing circuit. The processing circuit may implement a feedback path comprising a feedback filter having a response that generates a feedback anti-noise signal based on the error microphone signal, the feedback filter comprising a plurality of biquad filters and wherein the anti-noise signal is generated from the feedback anti-noise signal and an event detection and oversight control that detects that an ambient audio event is occurring that could cause the feedback filter to generate an undesirable component in the anti-noise signal, and controls filter coefficients of one or more of the plurality of biquad filters to reduce the undesirable component.

29 Claims, 5 Drawing Sheets

SYSTEMS AND METHODS FOR MODIFYING BIQUAD FILTERS OF A FEEDBACK FILTER IN FEEDBACK ACTIVE NOISE CANCELLATION

FIELD OF DISCLOSURE

The present disclosure relates in general to adaptive noise cancellation in connection with an acoustic transducer, and more particularly, performance and stability control for feedback active noise cancellation.

BACKGROUND

Wireless telephones, such as mobile/cellular telephones, cordless telephones, and other consumer audio devices, such as mp3 players, are in widespread use. Performance of such devices with respect to intelligibility can be improved by providing noise cancelling using a microphone to measure ambient acoustic events and then using signal processing to insert an anti-noise signal into the output of the device to cancel the ambient acoustic events.

In an adaptive noise cancellation system, it is often desirable for the system to be fully adaptive such that a maximum noise cancellation effect is provided to a user at all times. Adaptive noise cancellation systems often use a fixed feedback controller due to low cost, simplicity, wideband noise cancellation, and other advantages. However, existing feedback noise cancellation systems have disadvantages. For example, feedback noise cancellation cancels at least a portion of a source audio signal which may cause degraded audio performance of a device. In order to maintain reasonable audio performance, the gain of the feedback controller may need to be reduced, and thus noise cancellation performance is compromised. In addition, due to varying conditions (e.g., different shapes of user's ears, different ways users wear headphones, etc.), noise cancellation strength may differ from user to user.

Existing approaches to feedback adaptive noise cancellation may have disadvantages, particularly in environments having a low amount of ambient noise. For example, existing approaches to feedback adaptive noise cancellation may negatively impact signal magnitude and phase relationships. In addition, using traditional approaches, to reduce signal boosting occurring at particular frequencies (e.g., added system noise resulting at larger signals at such particular frequencies), the feedback gain of a feedback filter used in feedback adaptive noise cancellation may have to be strongly attenuated, resulting in reduction of adaptive noise cancellation at other frequencies.

SUMMARY

In accordance with the teachings of the present disclosure, certain disadvantages and problems associated with existing approaches to feedback adaptive noise cancellation may be reduced or eliminated.

In accordance with embodiments of the present disclosure, an integrated circuit may include an output for providing an output signal to a transducer including both a source audio signal for playback to a listener and an anti-noise signal for countering the effect of ambient audio sounds in an acoustic output of the transducer, an error microphone input for receiving an error microphone signal indicative of the output of the transducer and the ambient audio sounds at the transducer, and a processing circuit. The processing circuit may implement a feedback path comprising a feedback filter having a response that generates a feedback anti-noise signal based on the error microphone signal, the feedback filter comprising a plurality of biquad filters and wherein the anti-noise signal is generated from the feedback anti-noise signal and an event detection and oversight control that detects that an ambient audio event is occurring that could cause the feedback filter to generate an undesirable component in the anti-noise signal, and controls filter coefficients of one or more of the plurality of biquad filters to reduce the undesirable component.

In accordance with these and other embodiments of the present disclosure, a method for cancelling ambient audio sounds in the proximity of a transducer may include receiving an error microphone signal indicative of the output of the transducer and ambient audio sounds at the transducer, generating an anti-noise signal for countering the effects of ambient audio sounds at an acoustic output of the transducer, wherein generating the anti-noise signal comprises a feedback anti-noise signal based on the error microphone signal and generated by a feedback filter comprising a plurality of biquad filters, monitoring for an ambient audio event that could cause the feedback filter to generate an undesirable component in the anti-noise signal, controlling filter coefficients of one or more of the plurality of biquad filters to reduce the undesirable component, and combining the anti-noise signal with a source audio signal to generate an audio signal provided to the transducer.

In accordance with these and other embodiments of the present disclosure, a personal audio device may include a transducer and an integrated circuit communicatively coupled to the transducer. The integrated circuit may include an output for providing an output signal to the transducer including both a source audio signal for playback to a listener and an anti-noise signal for countering the effect of ambient audio sounds in an acoustic output of the transducer, an error microphone input for receiving an error microphone signal indicative of the output of the transducer and the ambient audio sounds at the transducer, and a processing circuit. The processing circuit may include a feedback path comprising a feedback filter having a response that generates a feedback anti-noise signal based on the error microphone signal, the feedback filter comprising a plurality of biquad filters and wherein the anti-noise signal is generated from the feedback anti-noise signal and an event detection and oversight control that detects that an ambient audio event is occurring that could cause the feedback filter to generate an undesirable component in the anti-noise signal, and controls filter coefficients of one or more of the plurality of biquad filters to reduce the undesirable component.

Technical advantages of the present disclosure may be readily apparent to one skilled in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

The present disclosure encompasses noise cancelling techniques and circuits that can be implemented in a personal audio device, such as a wireless telephone. The personal audio device includes an ANC circuit that may measure the ambient acoustic environment and generate a signal that is injected in the speaker (or other transducer) output to cancel ambient acoustic events. A reference microphone may be provided to measure the ambient acoustic environment, and an error microphone may be included for controlling the adaptation of the anti-noise signal to cancel the ambient audio sounds and for correcting for the electro-acoustic path from the output of the processing circuit through the transducer.

Figure 1A:
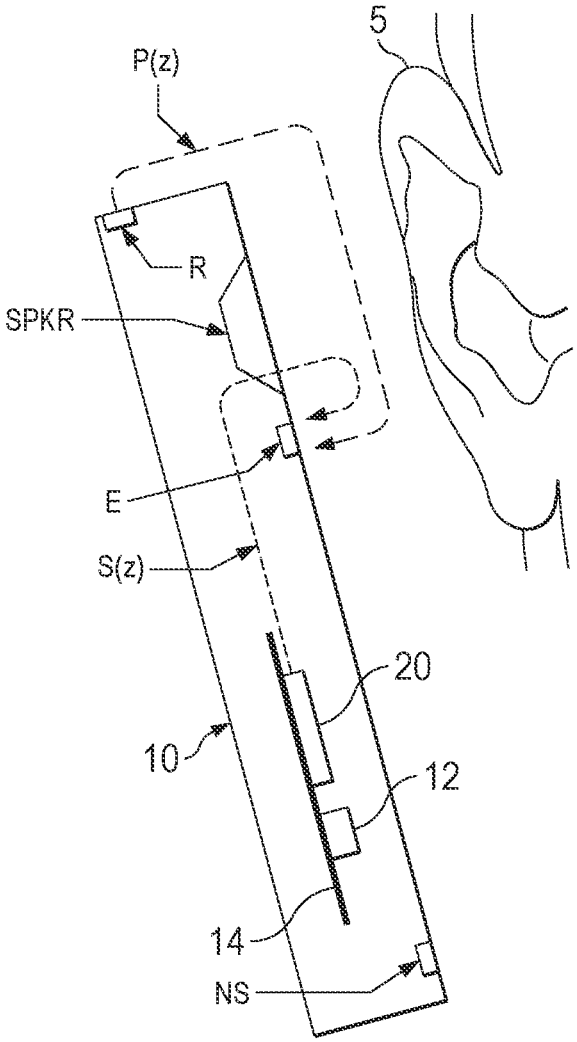
FIG. 1A is an illustration of an example personal audio device, in accordance with embodiments of the present disclosure.

Referring now to FIG. 1A, a personal audio device 10 as illustrated in accordance with embodiments of the present disclosure is shown in proximity to a human ear 5. Personal audio device 10 is an example of a device in which techniques in accordance with embodiments of this disclosure may be employed, but it is understood that not all of the elements or configurations embodied in illustrated personal audio device 10, or in the circuits depicted in subsequent illustrations, are required in order to practice the inventions recited in the claims. Personal audio device 10 may include a transducer such as speaker SPKR that reproduces distant speech received by personal audio device 10, along with other local audio events such as ringtones, stored audio program material, injection of near-end speech (i.e., the speech of the user of personal audio device 10) to provide a balanced conversational perception, and other audio that requires reproduction by personal audio device 10, such as sources from webpages or other network communications received by personal audio device 10 and audio indications such as a low battery indication and other system event notifications. A near-speech microphone NS may be provided to capture near-end speech, which is transmitted from personal audio device 10 to the other conversation participant(s).

Personal audio device 10 may include ANC circuits and features that inject an anti-noise signal into speaker SPKR to improve intelligibility of the distant speech and other audio reproduced by speaker SPKR. A reference microphone R may be provided for measuring the ambient acoustic environment, and may be positioned away from the typical position of a user's mouth, so that the near-end speech may be minimized in the signal produced by reference microphone R. Another microphone, error microphone E, may be provided in order to further improve the ANC operation by providing a measure of the ambient audio combined with the audio reproduced by speaker SPKR close to ear 5, when personal audio device 10 is in close proximity to ear 5. In other embodiments, additional reference and/or error microphones may be employed. Circuit 14 within personal audio device 10 may include an audio CODEC integrated circuit (IC) 20 that receives the signals from reference microphone R, near-speech microphone NS, and error microphone E and interfaces with other integrated circuits such as a radio-frequency (RF) integrated circuit 12 having a wireless telephone transceiver. In some embodiments of the disclosure, the circuits and techniques disclosed herein may be incorporated in a single integrated circuit that includes control circuits and other functionality for implementing the entirety of the personal audio device, such as an MP3 player-on-a-chip integrated circuit. In these and other embodiments, the circuits and techniques disclosed herein may be implemented partially or fully in software and/or firmware embodied in computer-readable media and executable by a controller or other processing device.

In general, ANC techniques of the present disclosure measure ambient acoustic events (as opposed to the output of speaker SPKR and/or the near-end speech) impinging on reference microphone R, and by also measuring the same ambient acoustic events impinging on error microphone E, ANC processing circuits of personal audio device 10 adapt an anti-noise signal generated from the output of reference microphone R to have a characteristic that minimizes the amplitude of the ambient acoustic events at error microphone E. Because acoustic path P(z) extends from reference microphone R to error microphone E, ANC circuits are effectively estimating acoustic path P(z) while removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to personal audio device 10, when personal audio device 10 is not firmly pressed to ear 5. While the illustrated personal audio device 10 includes a two-microphone ANC system with a third near-speech microphone NS, some aspects of the present invention may be practiced in a system that does not include separate error and reference microphones, or a wireless telephone that uses near-speech microphone NS to perform the function of the reference microphone R. Also, in personal audio devices designed only for audio playback, near-speech microphone NS will generally not be included, and the near-speech signal paths in the circuits described in further detail below may be omitted, without changing the scope of the disclosure, other than to limit the options provided for input to the microphone.

Figure 1B:
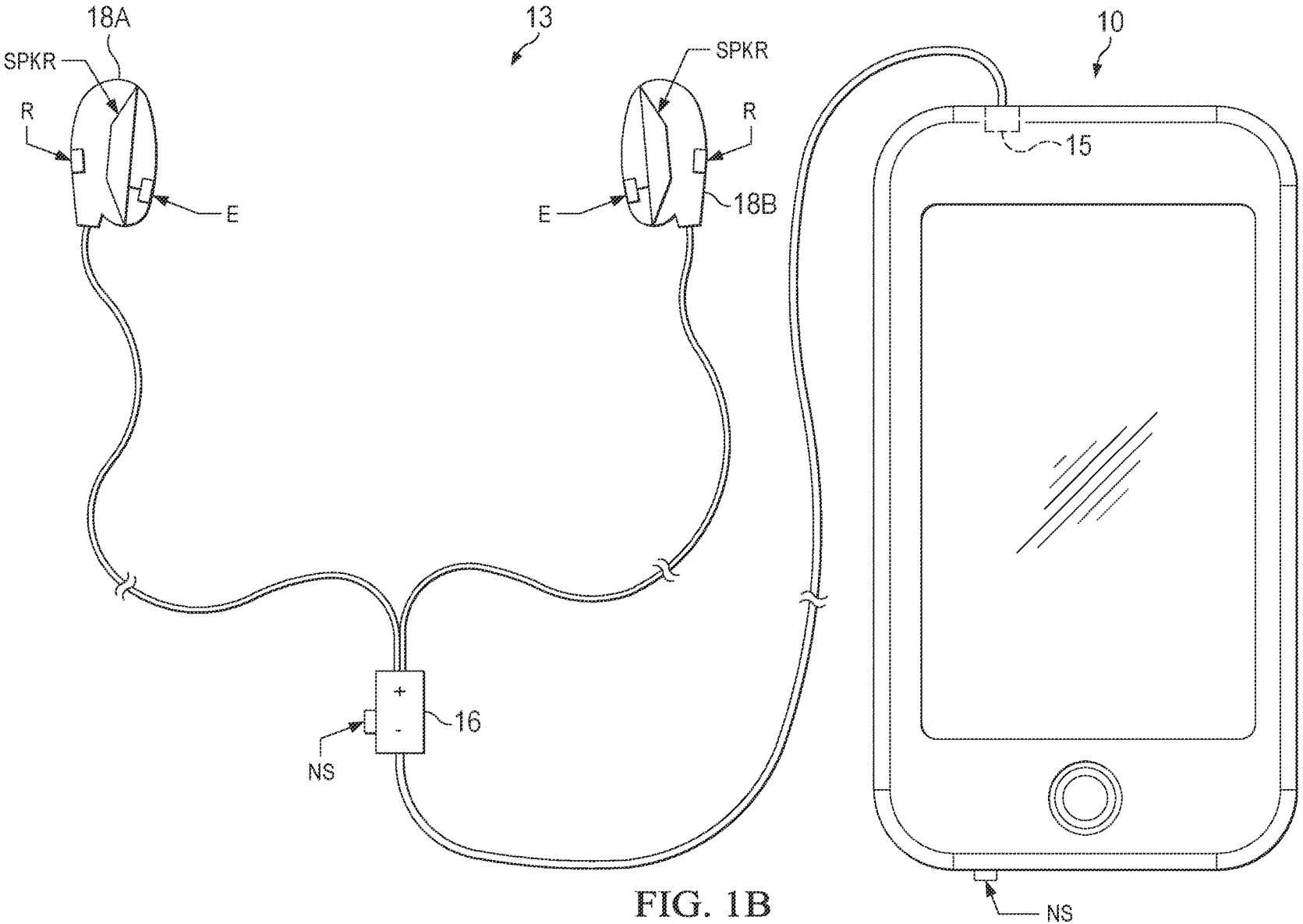
FIG. 1B is an illustration of an example personal audio device with a headphone assembly coupled thereto, in accordance with embodiments of the present disclosure.

Referring now to FIG. 1B, personal audio device 10 is depicted having a headphone assembly 13 coupled to it via audio port 15. Audio port 15 may be communicatively coupled to RF integrated circuit 12 and/or CODEC IC 20, thus permitting communication between components of headphone assembly 13 and one or more of RF integrated circuit 12 and/or CODEC IC 20. As shown in FIG. 1B, headphone assembly 13 may include a combox 16, a left headphone 18A, and a right headphone 18B. In some embodiments, headphone assembly 13 may comprise a wireless headphone assembly, in which case all or some portions of CODEC IC 20 may be present in headphone assembly 13, and headphone assembly 13 may include a wireless communication interface (e.g., BLUETOOTH) in order to communicate between headphone assembly 13 and personal audio device 10.

As used in this disclosure, the term "headphone" broadly includes any loudspeaker and structure associated therewith that is intended to be mechanically held in place proximate to a listener's ear canal, and includes without limitation earphones, earbuds, and other similar devices. As more specific examples, "headphone" may refer to intra-concha earphones, supra-concha earphones, and supra-aural earphones.

Combox 16 or another portion of headphone assembly 13 may have a near-speech microphone NS to capture near-end speech in addition to or in lieu of near-speech microphone NS of personal audio device 10. In addition, each headphone 18A, 18B may include a transducer such as speaker SPKR that reproduces distant speech received by personal audio device 10, along with other local audio events such as ringtones, stored audio program material, injection of near-end speech (i.e., the speech of the user of personal audio device 10) to provide a balanced conversational perception, and other audio that requires reproduction by personal audio device 10, such as sources from webpages or other network communications received by personal audio device 10 and audio indications such as a low battery indication and other system event notifications. Each headphone 18A, 18B may include a reference microphone R for measuring the ambient acoustic environment and an error microphone E for measuring of the ambient audio combined with the audio reproduced by speaker SPKR close to a listener's ear when such headphone 18A, 18B is engaged with the listener's ear. In some embodiments, CODEC IC 20 may receive the signals from reference microphone R and error microphone E of each headphone and near-speech microphone NS, and perform adaptive noise cancellation for each headphone as described herein. In other embodiments, a CODEC IC or another circuit may be present within headphone assembly 13, communicatively coupled to reference microphone R, near-speech microphone NS, and error microphone E, and configured to perform adaptive noise cancellation as described herein.

Figure 2:
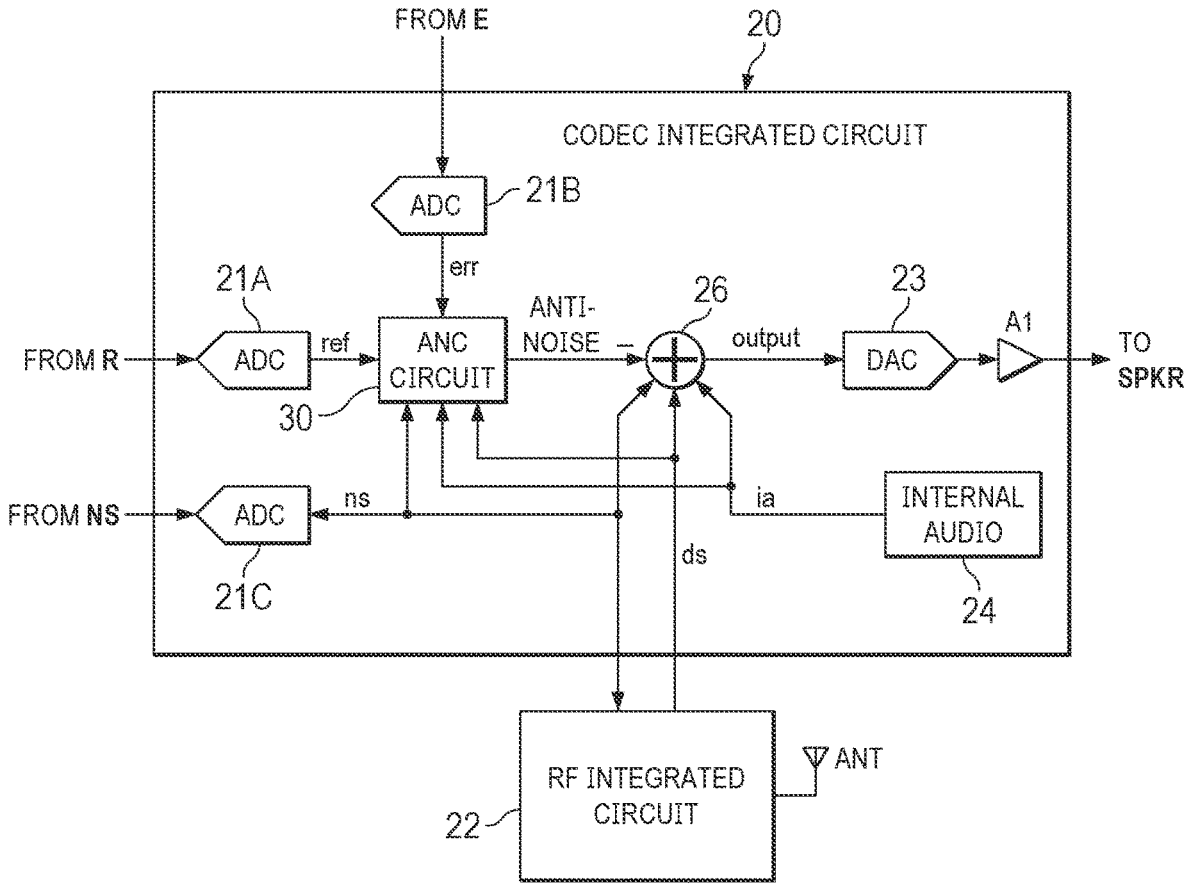
FIG. 2 is a block diagram of selected circuits within the personal audio device depicted in FIGS. 1A and 1B, in accordance with embodiments of the present disclosure.

Referring now to FIG. 2, selected circuits within personal audio device 10 are shown in a block diagram, which in other embodiments may be placed in whole or in part in other locations such as one or more headphones or earbuds. CODEC IC 20 may include an analog-to-digital converter (ADC) 21A for receiving the reference microphone signal from microphone R and generating a digital representation ref of the reference microphone signal, an ADC 21B for receiving the error microphone signal from error microphone E and generating a digital representation err of the error microphone signal, and an ADC 21C for receiving the near speech microphone signal from near speech microphone NS and generating a digital representation ns of the near speech microphone signal. CODEC IC 20 may generate an output for driving speaker SPKR from an amplifier A1, which may amplify the output of a digital-to-analog converter (DAC) 23 that receives the output of a combiner 26. Combiner 26 may combine audio signals is from internal audio sources 24, the anti-noise signal generated by ANC circuit 30, which by convention has the same polarity as the noise in reference microphone signal ref and is therefore subtracted by combiner 26, and a portion of near speech microphone signal ns so that the user of personal audio device 10 may hear his or her own voice in proper relation to downlink speech ds, which may be received from radio frequency (RF) integrated circuit 22 and may also be combined by combiner 26. Near speech microphone signal ns may also be provided to RF integrated circuit 22 and may be transmitted as uplink speech to the service provider via antenna ANT.

Figure 3:
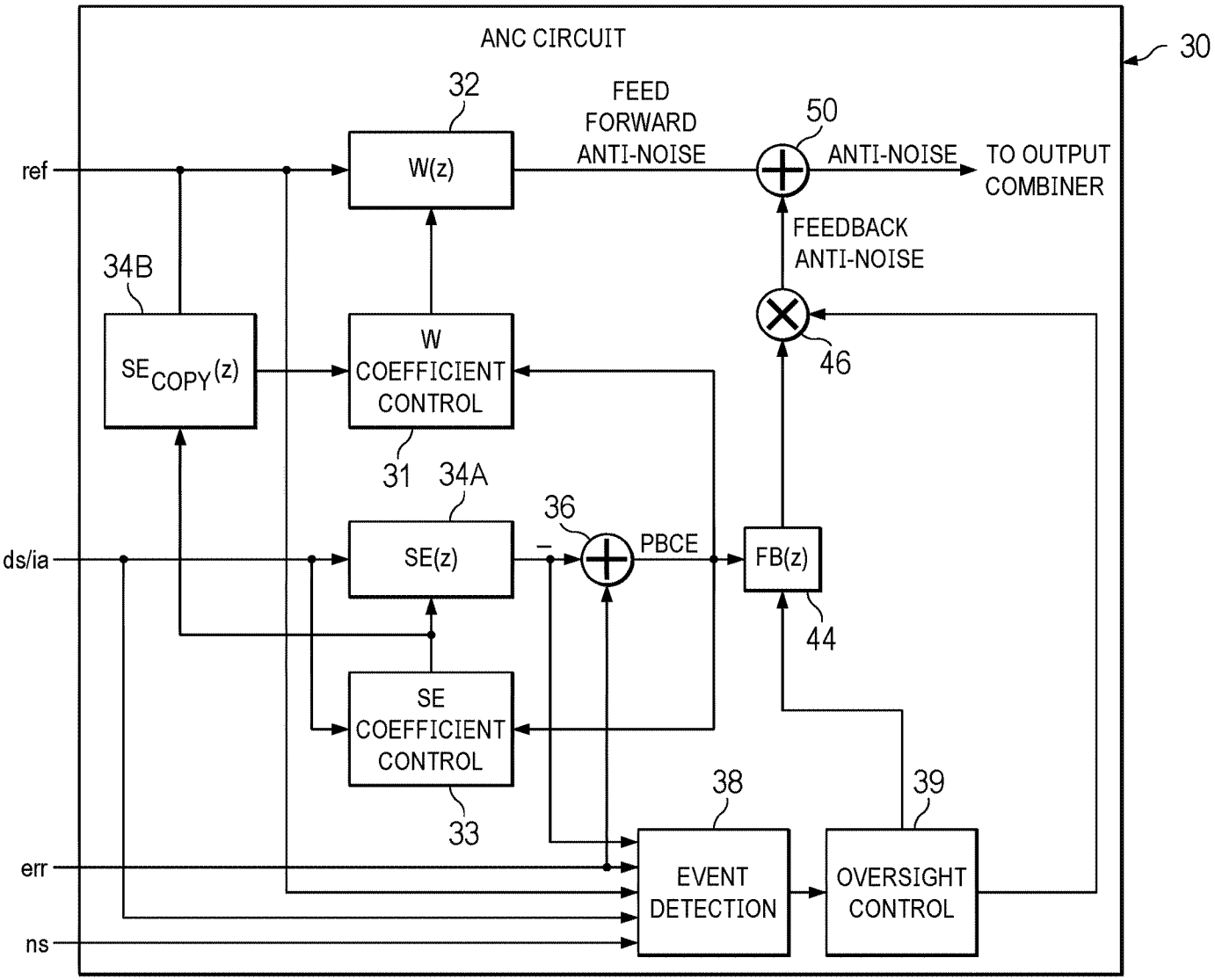
FIG. 3 is a block diagram depicting selected signal processing circuits and functional blocks within an example adaptive noise cancelling (ANC) circuit of a coder-decoder (CODEC) integrated circuit of FIG. 2 which uses feedforward filtering and feedback filtering to generate an anti-noise signal, in accordance with embodiments of the present disclosure.

Referring now to FIG. 3, details of ANC circuit 30 which may be used to implement ANC circuit 30 are shown in accordance with embodiments of the present disclosure. Adaptive filter 32 may receive reference microphone signal ref and under ideal circumstances, may adapt its transfer function W(z) to be P(z)/S(z) to generate a feedforward anti-noise component of the anti-noise signal, which may be combined by combiner 50 with a feedback anti-noise component of the anti-noise signal (described in greater detail below) to generate an anti-noise signal which in turn may be provided to an output combiner that combines the anti-noise signal with the source audio signal to be reproduced by the transducer, as exemplified by combiner 26 of FIG. 2. The coefficients of adaptive filter 32 may be controlled by a W coefficient control block 31 that uses a correlation of signals to determine the response of adaptive filter 32, which generally minimizes the error, in a least-mean squares sense, between those components of reference microphone signal ref present in error microphone signal err. The signals compared by W coefficient control block 31 may be the reference microphone signal ref as shaped by a copy of an estimate of the response of path S(z) provided by filter 34B and another signal that includes error microphone signal err. By transforming reference microphone signal ref with a copy of the estimate of the response of path S(z), response $SE_{COPY}(z)$, and minimizing the ambient audio sounds in the error microphone signal, adaptive filter 32 may adapt to the desired response of P(z)/S(z). In addition to error microphone signal err, the signal compared to the output of filter 34B by W coefficient control block 31 may include an inverted amount of downlink audio signal ds and/or internal audio signal ia that has been processed by filter response SE(z), of which response $SE_{COPY}(z)$ is a copy. By injecting an inverted amount of downlink audio signal ds and/or internal audio signal ia, adaptive filter 32 may be prevented from adapting to the relatively large amount of downlink audio and/or internal audio signal present in error microphone signal err. However, by transforming that inverted copy of downlink audio signal ds and/or internal audio signal ia with the estimate of the response of path S(z), the downlink audio and/or internal audio that is removed from error microphone signal err should match the expected version of downlink audio signal ds and/or internal audio signal ia reproduced at error microphone signal err, because the electrical and acoustical path of S(z) is the path taken by downlink audio signal ds and/or internal audio signal ia to arrive at error microphone E. Filter 34B may not be an adaptive filter, per se, but may have an adjustable response that is tuned to match the response of adaptive filter 34A, so that the response of filter 34B tracks the adapting of adaptive filter 34A.

To implement the above, adaptive filter 34A may have coefficients controlled by SE coefficient control block 33, which may compare downlink audio signal ds and/or internal audio signal ia and error microphone signal err after removal of the above-described filtered downlink audio signal ds and/or internal audio signal ia, that has been filtered by adaptive filter 34A to represent the expected downlink audio delivered to error microphone E, and which is removed from the output of adaptive filter 34A by a combiner 36 to generate a playback-corrected error, shown as PBCE in FIG. 3. SE coefficient control block 33 may correlate the actual downlink speech signal ds and/or internal audio signal ia with the components of downlink audio signal ds and/or internal audio signal ia that are present in error microphone signal err. Adaptive filter 34A may thereby be adapted to generate a signal from downlink audio signal ds and/or internal audio signal ia, that when subtracted from error microphone signal err, contains the content of error microphone signal err that is not due to downlink audio signal ds and/or internal audio signal ia.

As depicted in FIG. 3, ANC circuit 30 may also comprise feedback filter 44. Feedback filter 44 may receive the playback corrected error signal PBCE and may apply a response FB(z) to generate a feedback signal based on the playback corrected error. Also as depicted in FIG. 3, a path of the feedback anti-noise component may have a programmable gain element 46 in series with feedback filter 44 such that the product of response FB(z) and a gain of programmable gain element 46 is applied to playback corrected error signal PBCE in order to generate the feedback anti-noise component of the anti-noise signal. The feedback anti-noise component of the anti-noise signal may be combined by combiner 50 with the feedforward anti-noise component of the anti-noise signal to generate the anti-noise signal which in turn may be provided to an output combiner that combines the anti-noise signal with the source audio signal to be reproduced by the transducer, as exemplified by combiner 26 of FIG. 2.

In operation, an increased gain of programmable gain element 46 may cause increased noise cancellation of the feedback anti-noise component, and a decreased gain may cause reduced noise cancellation of the feedback anti-noise component. In some embodiments, as described in greater detail below, oversight control 39, in conjunction with event detection block 38, may control the gain of programmable gain element 46 in response to detection of an ambient audio event that could cause feedback filter 44 to generate an undesirable component in the anti-noise signal in order to reduce the undesirable component.

Event detection 38 and oversight control block 39 may perform various actions in response to various events, as described in greater detail herein, including, without limitation, controlling the gain of programmable gain element 46. In some embodiments, event detection 38 and oversight control block 39 may be similar in structure and/or functionality as the event detection and oversight control logic described in U.S. patent application Ser. No. 13/309,494 by Jon D. Hendrix et al., filed Dec. 1, 2011, entitled "Oversight Control of an Adaptive Noise Canceler in a Personal Audio Device," and assigned to the applicant of the present application. U.S. patent application Ser. No. 13/309,494 is incorporated by reference herein in its entirety.

Figure 4:
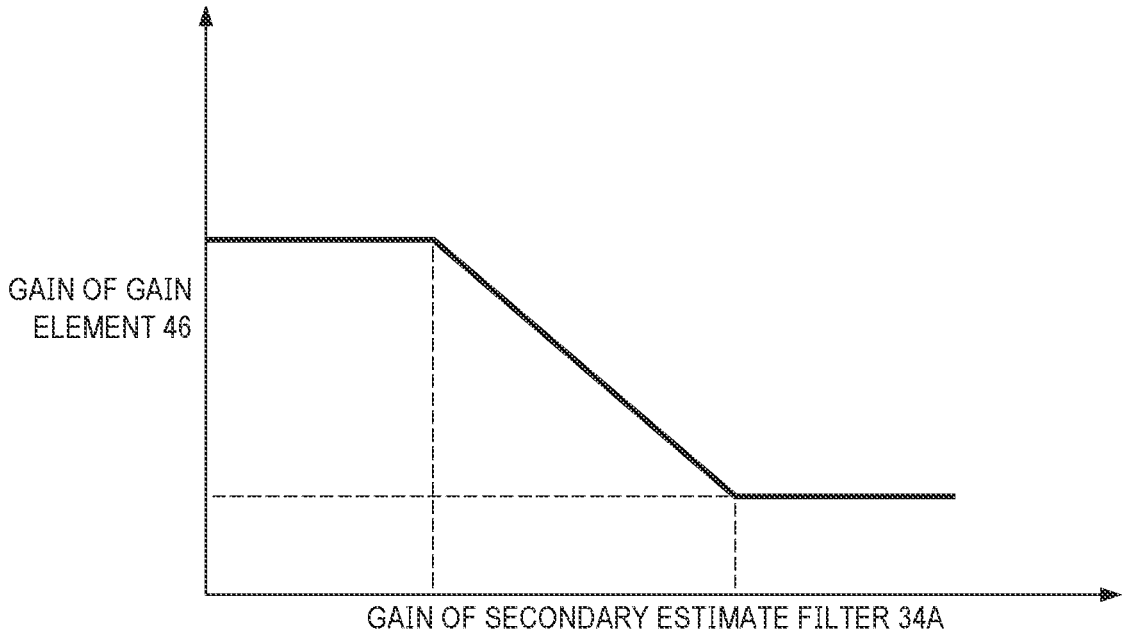
FIG. 4 illustrates a graph depicting an example gain calculated by an event detection and oversight control block as a function of a gain of a secondary estimate filter in accordance with embodiments of the present disclosure.

In some embodiments, event detection 38 and oversight control block 39 may monitor signals within ANC circuit 30 (e.g., source audio signal ds/ia and a signal output by secondary estimate filter 34A), in order to determine a gain of secondary estimate filter 34A and/or magnitude of the response SE(z) of secondary estimate filter 34A. Because secondary estimate filter 34A models the electroacoustic path to a user's ear, response SE(z) indicates how speaker SPKR is acoustically coupled to the user's ear. Thus, a magnitude or gain of response SE(z) at certain frequency bands may indicate how loose or tight a device (e.g., a headphone) is coupled to a user's ear. Because response SE(z) may be continuously trained by ANC circuit 30, change in response SE(z), and thus the change in fitting of speaker SPKR to the user's ear, may be tracked over time, and the gain of the programmable feedback element 46 may be adjusted as a function of the change in response SE(z). FIG. 4 illustrates a graph depicting an example gain calculated by event detection 38 and oversight control block 39 as a function of a gain of secondary estimate filter 34A, in accordance with embodiments of the present disclosure. As shown in FIG. 4, the gain of gain element 46 may increase when a gain of secondary path estimate filter 34A decreases and may decrease when the gain of secondary path estimate filter 34A increases.

Figure 5:
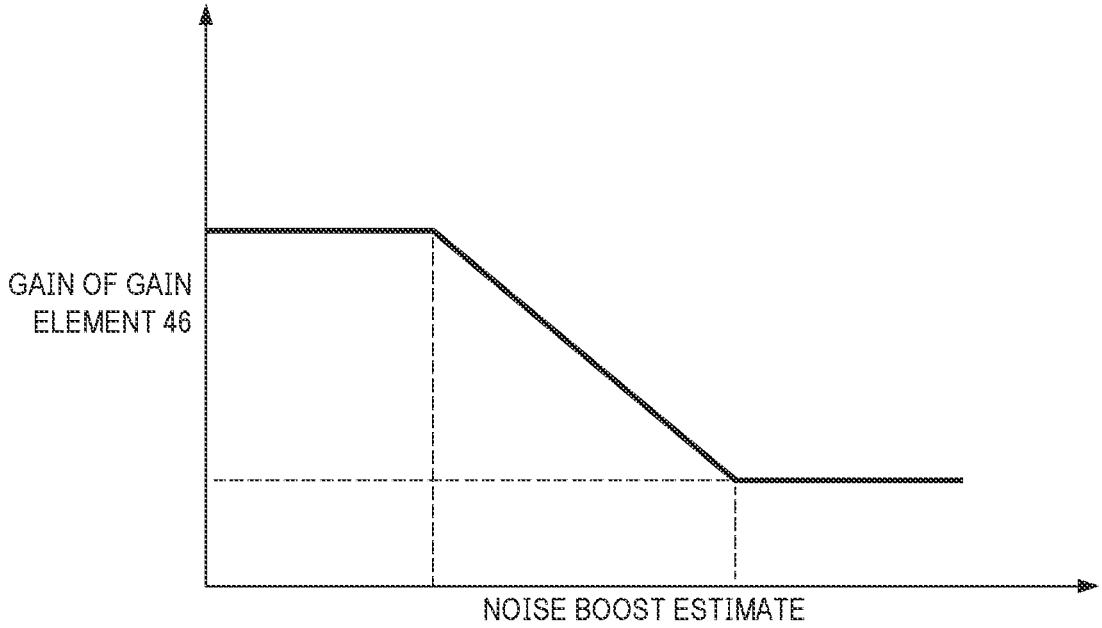
FIG. 5 illustrates a graph depicting an example gain calculated by an event detection and oversight control block as a function of a gain of a noise boost estimate, in accordance with embodiments of the present disclosure.

As another example, in these and other embodiments, event detection 38 and oversight control block 39 may monitor signals within ANC circuit 30 (e.g., playback corrected error PBCE and reference microphone signal ref) to determine a noise boost estimate of ANC circuit 30. In general, when ANC circuit 30 is operating properly, error microphone E may typically sense less sound pressure than reference microphone R in the absence of a source audio signal. However, if the feedback loop comprising feedback filter 44 is unstable or does not perform as expected due to changes in the secondary path or because the secondary path is different than expected, error microphone E may sense higher sound pressure than reference microphone R. The amount of noise boost may be estimated by comparing the level of difference between or the ratio of playback corrected error PBCE and reference microphone signal ref, which may be performed in the time domain and/or frequency domain. Based on such noise boost estimate, event detection 38 and oversight control block 39 may control the gain of the programmable feedback element 46. FIG. illustrates a graph depicting an example gain calculated by event detection 38 and oversight control block 39 as a function of a gain of the noise boost estimate, in accordance with embodiments of the present disclosure. As shown in FIG. 5, the gain of gain element 46 may increase when the noise boost estimate decreases and may decrease when the noise boost estimate increases. In some embodiments, event detection 38 and oversight control block 39 may vary gain of gain element 46 as a function of the noise boost estimate when information regarding the gain of secondary path estimate filter 34A is not available (e.g., when no training signal is available to adapt secondary path estimate filter 34A).

As another example, in these and other embodiments, event detection 38 and oversight control block 39 may monitor signals within ANC circuit 30 (e.g., playback corrected error PBCE and reference microphone signal ref) to determine if low-ambient conditions exist (e.g., if the sound intensity of ambient sound sensed by reference microphone R is below a particular threshold). In the event a low-ambient condition exists, event detection 38 and oversight control block 39 may modify parameters of one or more biquad filters that implement feedback filter 44, as described in greater detail below.

Figure 6:
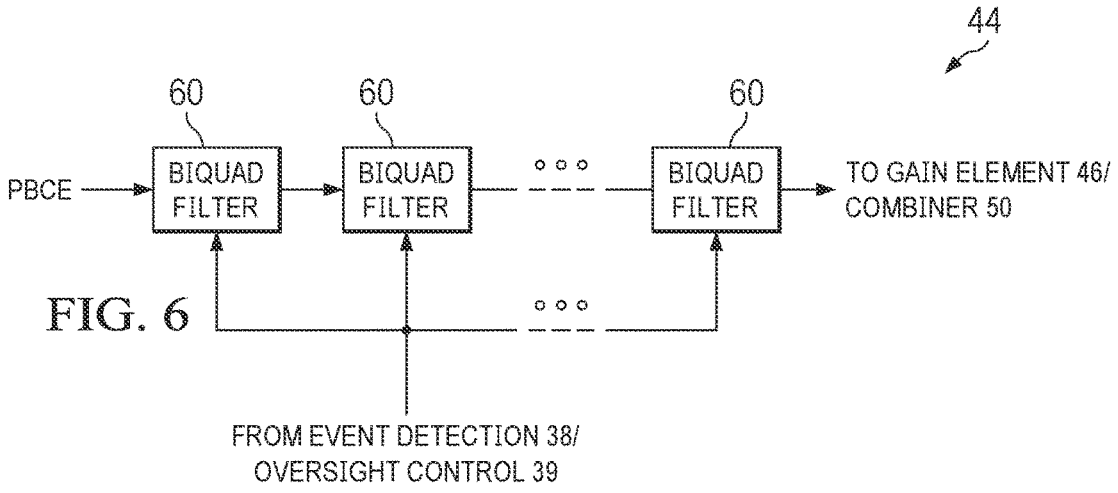
FIG. 6 is a block diagram depicting selected components of a feedback filter, in accordance with embodiments of the present disclosure.

FIG. 6 is a block diagram depicting selected components of feedback filter 44, in accordance with embodiments of the present disclosure. As shown in FIG. 6, feedback filter 44 may be implemented by a plurality of biquad filters 60 arranged in series, such that response FB(z) is a combination (e.g., product) of the individual responses of biquad filters

60. As known in the art, each biquad filter 60 may have a filter response that may be expressed as a ratio of two quadratic functions $$\left(\text{e.g., } \frac{b_0 + b_1^{z^{-1}} + b_2^{z^{-2}}}{1 + a_1^{z^{-1}} + a_2^{z^{-2}}}\right),$$

and each biquad filter 60 may have its own respective gain, poles, and zeroes in accordance with the coefficients $a_1$, $a_2$, $b_0$, $b_1$, and $b_2$ of such biquad filter 60.

In operation, in lieu of or in addition to controlling a gain of gain element 46, event detection 38 and oversight control block 39 may, in response to low-ambient conditions and/or other events detected by event detection 38, modify coefficients of one or more biquad filters 60 independently of one another, in order to modify a peak gain of each of the modified biquad filters 60, modify frequency characteristics (e.g., poles and/or zeroes) of each of the modified biquad filters 60, and/or modify a quality factor of each of the modified biquad filters 60. Such approach of modifying coefficients of one or more biquad filters 60 (as opposed to only modifying a gain of gain element 46) may improve feedback ANC performance in low-ambient environments as compared to traditional approaches. As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative. Accordingly, modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described above.

Unless otherwise specifically noted, articles depicted in the drawings are not necessarily drawn to scale.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

Although specific advantages have been enumerated above, various embodiments may include some, none, or all of the enumerated advantages. Additionally, other technical advantages may become readily apparent to one of ordinary skill in the art after review of the foregoing figures and description.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

What is claimed is:

1. An integrated circuit, comprising:

an output for providing an output signal to a transducer including both a source audio signal for playback to a listener and an anti-noise signal for countering the effect of ambient audio sounds in an acoustic output of the transducer;

an error microphone input for receiving an error microphone signal indicative of the output of the transducer and the ambient audio sounds at the transducer; and a processing circuit that implements:

a feedback path comprising a feedback filter having a response that generates a feedback anti-noise signal based on the error microphone signal, the feedback filter comprising a plurality of biquad filters and wherein the anti-noise signal is generated from the feedback anti-noise signal; and an event detection and oversight control that detects that an ambient audio event is occurring that causes the feedback filter to generate an undesirable component in the anti-noise signal, and controls filter coefficients of one or more of the plurality of biquad filters to reduce the undesirable component.

2. The integrated circuit of claim 1, wherein the plurality of biquad filters is arranged in series and the response of the feedback filter is a combination of individual filter responses of the plurality of biquad filters.

3. The integrated circuit of claim 1, wherein the event detection and oversight control controls filter coefficients of two or more of the plurality of biquad filters independently of one another to reduce the undesirable component.

4. The integrated circuit of claim 1, wherein the event detection and oversight control controls filter coefficients of the one or more of the plurality of biquad filters to reduce a respective peak gain of each of the one or more of the plurality of biquad filters.

5. The integrated circuit of claim 1, wherein the event detection and oversight control controls filter coefficients of the one or more of the plurality of biquad filters to control respective frequency characteristics of each of the one or more of the plurality of biquad filters.

6. The integrated circuit of claim 1, wherein the event detection and oversight control controls filter coefficients of the one or more of the plurality of biquad filters to control respective quality factors of each of the one or more of the plurality of biquad filters.

7. The integrated circuit of claim 1, wherein:

the processing circuit further implements a variable gain element in series with the feedback filter; and the event detection and oversight control controls a gain of the variable gain element to reduce the undesirable component.

8. The integrated circuit of claim 1, wherein the ambient audio event is a low-ambient condition in which ambient noise proximate to the transducer is below a particular threshold.

9. The integrated circuit of claim 1, wherein the processing circuit further implements:

a secondary path estimate filter configured to model an electro-acoustic path of the source audio signal and have a response that generates a secondary path estimate from the source audio signal; and a secondary path estimate coefficient control block that shapes the response of the secondary path estimate filter in conformity with the source audio signal and a playback corrected error by adapting the response of the secondary path estimate filter to minimize a playback corrected error, wherein the playback corrected error is based on a difference between the error microphone signal and the secondary path estimate.

10. The integrated circuit of claim 9, wherein the ambient audio event is a change in the response of the secondary path estimate filter.

11. The integrated circuit of claim 9, further comprising a reference microphone input for receiving a reference microphone signal indicative of the ambient audio sounds, wherein the ambient audio event is a change in a noise boost of the integrated circuit, further wherein the noise boost is based on a difference between a magnitude of the playback corrected error and a magnitude of the reference microphone signal.

12. The integrated circuit of claim 1, further comprising a reference microphone input for receiving a reference microphone signal indicative of the ambient audio sounds, and wherein the ambient audio event is a signal due to positive feedback through the reference microphone due to alteration of coupling between the transducer and the reference microphone.

13. The integrated circuit of claim 1, wherein the ambient audio event is a signal due to positive feedback through the error microphone due to alteration of coupling between the transducer and the error microphone.

14. The integrated circuit of claim 1, further comprising a reference microphone input for receiving a reference microphone signal indicative of the ambient audio sounds, and wherein the ambient audio event is a low-ambient condition in which ambient noise proximate detected within the reference microphone signal is below a particular threshold.

15. A method for cancelling ambient audio sounds in the proximity of a transducer, comprising:

receiving an error microphone signal indicative of an output of the transducer and ambient audio sounds at the transducer;

generating an anti-noise signal for countering the effects of ambient audio sounds at an acoustic output of the transducer, wherein generating the anti-noise signal comprises a feedback anti-noise signal based on the error microphone signal and generated by a feedback filter comprising a plurality of biquad filters;

monitoring for an ambient audio event that causes the feedback filter to generate an undesirable component in the anti-noise signal;

controlling filter coefficients of one or more of the plurality of biquad filters to reduce the undesirable component; and combining the anti-noise signal with a source audio signal to generate an audio signal provided to the transducer.

16. The method of claim 15, wherein the plurality of biquad filters is arranged in series and the response of the feedback filter is a combination of individual filter responses of the plurality of biquad filters.

17. The method of claim 15, wherein controlling filter coefficients of one or more of the plurality of biquad filters comprises controlling filter coefficients of two or more of the plurality of biquad filters independently of one another to reduce the undesirable component.

18. The method of claim 15, wherein controlling filter coefficients of one or more of the plurality of biquad filters comprises controlling filter coefficients of the one or more of the plurality of biquad filters to reduce a respective peak gain of each of the one or more of the plurality of biquad filters.

19. The method of claim 15, wherein controlling filter coefficients of one or more of the plurality of biquad filters comprises controlling filter coefficients of the one or more of the plurality of biquad filters to control respective frequency characteristics of each of the one or more of the plurality of biquad filters.

20. The method of claim 15, wherein controlling filter coefficients of one or more of the plurality of biquad filters comprises controlling filter coefficients of the one or more of the plurality of biquad filters to control respective quality factors of each of the one or more of the plurality of biquad filters.

21. The method of claim 15, wherein controlling filter coefficients of one or more of the plurality of biquad filters comprises controlling controls a gain of a variable gain element in series with the feedback filter in order to reduce the undesirable component.

22. The method of claim 15, wherein the ambient audio event is a low-ambient condition in which ambient noise proximate to the transducer is below a particular threshold.

23. The method of claim 15, further comprising modelling an electro-acoustic path of the source audio signal with a secondary path estimate filter having a response that generates a secondary path estimate from the source audio signal; and shaping the response of the secondary path estimate filter in conformity with the source audio signal and a playback corrected error by adapting the response of the secondary path estimate filter to minimize a playback corrected error, wherein the playback corrected error is based on a difference between the error microphone signal and the secondary path estimate.

24. The method of claim 23, wherein the ambient audio event is a change in the response of the secondary path estimate filter.

25. The method of claim 23, further comprising receiving a reference microphone signal indicative of the ambient audio sounds, wherein the ambient audio event is a change in a noise boost, further wherein the noise boost is based on a difference between a magnitude of the playback corrected error and a magnitude of the reference microphone signal.

26. The method of claim 15, further comprising receiving a reference microphone signal indicative of the ambient audio sounds, and wherein the ambient audio event is a signal due to positive feedback through the reference microphone due to alteration of coupling between the transducer and the reference microphone.

27. The method of claim 15, wherein the ambient audio event is a signal due to positive feedback through the error microphone due to alteration of coupling between the transducer and the error microphone.

28. The method of claim 15, further comprising receiving a reference microphone signal indicative of the ambient audio sounds, and wherein the ambient audio event is a low-ambient condition in which ambient noise proximate detected within the reference microphone signal is below a particular threshold.

29. A personal audio device comprising:

a transducer; and an integrated circuit communicatively coupled to the transducer and comprising:

an output for providing an output signal to the transducer including both a source audio signal for playback to a listener and an anti-noise signal for countering the effect of ambient audio sounds in an acoustic output of the transducer;

an error microphone input for receiving an error microphone signal indicative of the output of the transducer and the ambient audio sounds at the transducer; and a processing circuit that implements:

a feedback path comprising a feedback filter having a response that generates a feedback anti-noise signal based on the error microphone signal, the feedback filter comprising a plurality of biquad filters and wherein the anti-noise signal is generated from the feedback anti-noise signal; and an event detection and oversight control that detects that an ambient audio event is occurring that causes the feedback filter to generate an undesirable component in the anti-noise signal, and controls filter coefficients of one or more of the plurality of biquad filters to reduce the undesirable component.

* * * * *